US009363614B2

(12) United States Patent
Jepsen et al.

(10) Patent No.: US 9,363,614 B2
(45) Date of Patent: Jun. 7, 2016

(54) METHOD OF FITTING A HEARING AID SYSTEM AND A HEARING AID FITTING SYSTEM

(71) Applicant: WIDEX A/S, Lynge (DK)

(72) Inventors: Morten Love Jepsen, Lynge (DK); Sigfrid Daniel Soli, Sierra Madre, CA (US)

(73) Assignee: Widex A/S, Lynge (DK)

( * ) Notice: Subject to any disclaimer, the term of this patent is extended or adjusted under 35 U.S.C. 154(b) by 127 days.

(21) Appl. No.: 14/192,475

(22) Filed: Feb. 27, 2014

(65) Prior Publication Data

US 2015/0245150 A1 Aug. 27, 2015

(51) Int. Cl.
*H04R 25/00* (2006.01)

(52) U.S. Cl.
CPC ..... *H04R 25/70* (2013.01); *H04R 25/50* (2013.01); *H04R 2225/43* (2013.01)

(58) Field of Classification Search
CPC .... H04R 25/30; H04R 25/305; H04R 25/356; H04R 25/50; H04R 25/502; H04R 25/505; H04R 25/558; H04R 25/70; H04R 2225/39; H04R 2225/41; H04R 2225/43; H04R 2225/49; A61B 5/12; A61B 5/121
USPC ..... 381/23.1, 60, 104, 106, 312, 314, 315, 381/317, 321; 704/E21.002, E21.004, 704/E21.009; 600/25
See application file for complete search history.

(56) References Cited

U.S. PATENT DOCUMENTS

| | | | | |
|---|---|---|---|---|
| 5,687,241 | A | 11/1997 | Ludvigsen | |
| 5,729,658 | A * | 3/1998 | Hou et al. | 704/270 |
| 7,804,973 | B2 | 9/2010 | De Vries et al. | |
| 9,025,800 | B2 * | 5/2015 | Kidmose et al. | 381/314 |
| 2005/0141737 | A1 * | 6/2005 | Hansen | 381/316 |
| 2006/0204025 | A1 * | 9/2006 | Paludan-Muller et al. | 381/317 |
| 2007/0003077 | A1 * | 1/2007 | Pedersen et al. | 381/106 |
| 2008/0317268 | A1 * | 12/2008 | Nordahn et al. | 381/321 |
| 2012/0243693 | A1 * | 9/2012 | Paludan-Muller et al. | 381/23.1 |
| 2014/0146987 | A1 * | 5/2014 | Pontoppidan et al. | 381/314 |
| 2014/0247956 | A1 * | 9/2014 | Andersen et al. | 381/316 |
| 2014/0270294 | A1 * | 9/2014 | Andersen et al. | 381/321 |
| 2015/0281857 | A1 * | 10/2015 | Hau | H04R 25/353 381/317 |

OTHER PUBLICATIONS

Soren Jorgensen, et al., "A multi-resolution envelope-power based model for speech intelligibility", Journal of Acoustical Soceity of America, Jul. 2013, pp. 436-446, vol. 134, No. 1.
Reinier Plomp, "A Signal-to-Noise Ratio Model for the Speech-Reception Threshold of the Hearing Impaired", J. Speech Hear Res, 1986, pp. 146-154, vol. 29.

(Continued)

*Primary Examiner* — Curtis Kuntz
*Assistant Examiner* — Joshua Kaufman
(74) *Attorney, Agent, or Firm* — Sughrue Mion, PLLC

(57) ABSTRACT

In a method of fitting a hearing aid system, a hearing aid user's hearing loss is classified and the hearing aid fitting is adapted in response to this classification. The hearing loss classification is, in one example, classified by determining an audiogram for the user, testing the user's hearing function under conditions that, for a user with that audiogram, would result in a predicted intelligibility, and comparing the measured intelligibility to the predicted intelligibility. Also disclosed is a hearing aid fitting system (100, 200) adapted to carry out the method.

27 Claims, 3 Drawing Sheets

(56) References Cited

OTHER PUBLICATIONS

Cees H. Taal, et al., "An Algorithm for Intelligibility Prediction of Time-Frequency Weighted Noisy Speech", IEEE Transaction on Audio, Speech, and Language Processing, Sep. 2011, pp. 2125-2136, vol. 19, No. 7.

"Methods for Calculation of the Speech Intelligibility Index", ANSI S3.5, 1997.

Koenraad S. Rhebergen, et al., "A Speech Intelligibility Index-based approach to predict the speech reception threshold for sentences in fluctuating noise for normal-hearing listeners", J. Acoust. Soc. Am., Apr. 1, 2005, pp. 2181-2192, vol. 117, No. 4.

Tammo Houtgast, et al., "On the auditory and cognitive functions that may explain an individual's elevation of the speech reception threshold in noise", International Journal of Audiology, 2008, pp. 287-295, vol. 47.

Robert L. Sherbecoe, et al., "Regression equations for the transfer functions of ANSI S.3.5-1969", J. Acoust. Soc. Am., 1990, pp. 2482-2483, vol. 88, No. 5.

* cited by examiner

METHOD OF FITTING A HEARING AID SYSTEM AND A HEARING AID FITTING SYSTEM

The present invention relates to a method of fitting a hearing aid system. The present invention also relates to a hearing aid fitting system.

BACKGROUND OF THE INVENTION

Generally a hearing aid system according to the invention is understood as meaning any system which provides an output signal that can be perceived as an auditory signal by a user or contributes to providing such an output signal, and which has means adapted to compensate for an individual hearing loss of the user or contribute to compensating for the hearing loss of the user. These systems may comprise hearing aids that can be worn on the body or on the head, in particular on or in the ear, or that can be fully or partially implanted. However, a device whose main aim is not to compensate for a hearing loss, for example a consumer electronic device (televisions, hi-fi systems, mobile phones, MP3 players etc.), may also be considered a hearing aid system, provided it has measures for compensating for an individual hearing loss.

Within the present context a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, e.g. a smart phone, having software applications adapted to interact with other devices of the hearing aid system. Thus within the present context the term "hearing aid system device" may denote a hearing aid or an external device.

In a traditional hearing aid fitting, the hearing aid user travels to an office of a hearing aid fitter, and the user's hearing aids are adjusted using the fitting equipment that the hearing aid fitter has in his office. Typically the fitting equipment comprises a computer capable of executing the relevant hearing aid programming software and a programming device adapted to provide a link between the computer and the hearing aid.

Hearing loss of a hearing impaired person is quite often frequency-dependent and may not be the same for both ears. This means that the hearing loss of the person varies depending on the frequency. Therefore, when compensating for hearing losses, it can be advantageous to utilize frequency-dependent amplification. Hearing aids therefore often provide band split filters in order to split an input sound signal received by an input transducer of the hearing aid, into various frequency intervals, also called frequency bands, which are independently processed. In this way it is possible to adjust the input sound signal of each frequency band individually to account for the hearing loss in respective frequency bands. The frequency dependent adjustment is normally done by implementing a band split filter and a compressor for each of the frequency bands, hereby forming so-called band split compressors, which may be combined to form a multi-band compressor. In this way it is possible to adjust the gain individually in each frequency band depending on the hearing loss as well as the input level of the input sound signal in a respective frequency band. For example, a band split compressor may provide a higher gain for a soft sound than for a loud sound in each frequency band.

Traditionally a hearing aid system is fitted based only on the recorded audiogram for the individual haring aid system user. However, it is well known that the benefit of wearing a hearing aid system may differ significantly for users having similar or even identical audiograms.

Therefore, there is a need to improve the audiological fitting of hearing aid systems. U.S. Pat. No. 7,804,973 B2 discloses a method of selecting parameters for one or more noise reduction algorithms based on the individual user's SNR loss. The term SNR loss is defined as the average increase in signal-to-noise ratio (SNR) needed for a hearing impaired patient relative to a normal hearing person in order to achieve similar performance (50% word recognition) on a hearing in noise test, at levels above the hearing threshold. According to an aspect of the disclosed method a degree of restoration/improvement of the SNR of noise contaminated input signals of the hearing aid system has been made dependent on the SNR loss of the individual user. However, this method does not use a classification of the type of hearing loss to guide the selection of hearing aid features, parameter settings, and gain rationales that have been specifically adapted for each type of hearing loss to be most beneficial in addressing the SNR loss.

The paper "A signal-to-noise ratio model for the speech-reception threshold of the hearing impaired" by Plomp published in the Journal of Speech and Hearing Research, Vol. 29, 146-154, June 1986 discloses a preferred method for measuring a Speech-Reception-Threshold (SRT) based on an adaptive trial-by-trial adjustment of the sound pressure level of a number of carefully selected sentences. The SRT is found as the sound pressure level required for obtaining a speech intelligibility of 50%. The paper further states that whereas word lists may have priority for diagnostic purposes, short meaningful sentences are more representative of conversational speech so that the threshold conditions are identical to the critical situations in normal practice. Sentences have the additional advantage that the slope of the psychometric function representing the intelligibility score as a function of sound-pressure level is steeper (20%/dB) than for single words. This is beneficial to an accurate estimation of the SRT.

The paper also defines speech communication handicap as elevation of the speech reception threshold (SRT) over that of the average SRT for individuals with normal hearing. There are two factors that can cause the SRT to be elevated, audibility loss (the functional hearing deficit that predominantly makes at least a part of the speech spectrum inaudible), and distortion loss (the functional hearing deficit that is due to distorted auditory processing). Audibility loss represents a loss of sensitivity, while distortion loss is the reduced ability to understand speech in background noise when both the speech and noise are audible. The SRT in quiet is elevated by both audibility loss and distortion loss, and the SRT in supra-threshold noise is elevated only by distortion loss. Thus, an individual's speech communication handicap can be characterized with two SRTs, one in quiet and the other in supra-threshold noise. While this is useful information for classifying functional impairment caused by hearing loss the article does not provide an automatic, effective and precise method of quantifying the extent of this impairment.

The paper "On the auditory and cognitive functions that may explain an individual's elevation of the speech reception threshold in noise" by Houtgast and Festen published in International Journal of Audiology 2008; 47: 287-295, considers a variety of auditory and cognitive functions that may underlie the so called distortion, that represents the additional factor that has to be taken into account in order to understand why a pure-tone audiogram is not sufficient to explain the varying results of speech-in-noise tests obtained by hearing aid users having similar audiograms.

Further the paper discloses a calculation of the Speech Intelligibility Index (SII) at a given SRT, noting that this calculation takes into consideration frequency-specific thresholds of audibility. It was found that when the SRT is elevated due only to the effects of impaired audibility, which is considered in the SII calculations, the SII at the elevated SRT remains the same as that of normally hearing individuals. However, if elevation of the SRT is due to the effects of increased distortion, the SII at the SRT is increased over that of normally hearing individuals.

Thus the paper discloses how measurements of the SRT and pure-tone thresholds, together with SII calculations, can be used to characterize the cause of communication handicap as due primarily to impaired audibility or distortion. While this is useful information for classifying functional impairment caused by hearing loss the article does not provide an automatic, effective and precise method of quantifying the extent of this impairment.

It is therefore a feature of the present invention to provide an improved method of fitting a hearing aid system.

It is another feature of the present invention to provide a hearing aid fitting system adapted to carry out an improved method of fitting a hearing aid system.

SUMMARY OF THE INVENTION

The invention, in a first aspect, provides a method of fitting a hearing aid system according to claim 1.

This provides an improved method of fitting a hearing aid system.

The invention, in a second aspect, provides a hearing aid fitting system according to claim 25.

This provides an improved hearing aid fitting system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
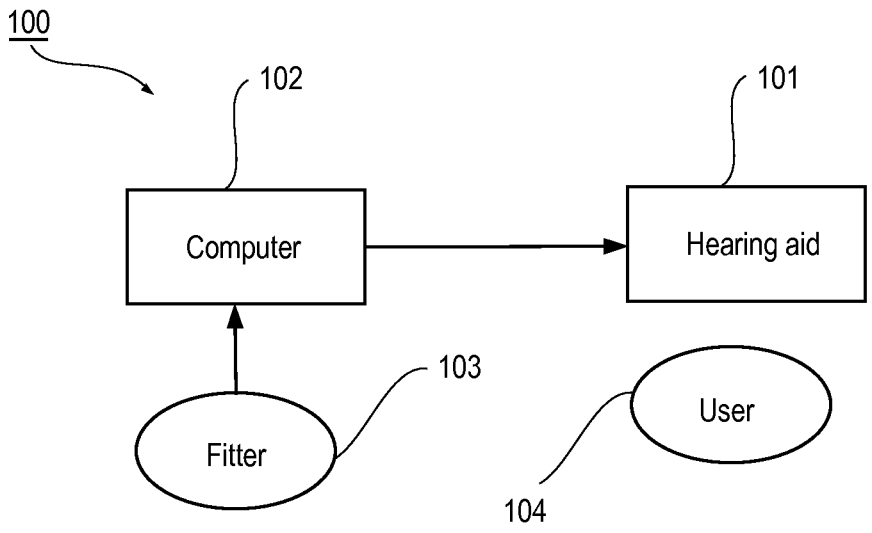
FIG. 1 illustrates highly schematically the devices required for carrying out a hearing aid fitting according to a first embodiment of the invention.

Within the present context the terms audibility loss and distortion loss are to be understood as specific types of functional hearing deficit. In the following the terms audibility loss, and attenuation loss may be used interchangeably and the same is true for distortion and distortion loss. Audibility loss represents the functional hearing deficit that predominantly makes at least a part of the speech spectrum inaudible and distortion loss represents the functional hearing deficit that is due to distorted auditory processing. Audibility loss represents a loss of sensitivity, while distortion is the reduced ability to understand speech in background noise when both the speech and noise are audible. However, in the following it is to be understood that most people suffering from a functional hearing deficit will have a mix of at least these two types of functional hearing deficit and therefore the terms audibility loss and distortion loss are to be understood as being predominantly of the respective type.

Within the present context it is furthermore understood that the value of any parameter may be denoted either simply by the name of the parameter or as the magnitude or value of the parameter.

The present invention addresses the fact that measured and perceived benefit from hearing aids varies across listeners having similar audiometric thresholds measured with conventional audiometry. It is recognized that the similar thresholds can be observed even if the underlying auditory pathology is different. Differences in auditory pathology will presumably lead to the observed differences in hearing aid benefit. Classification of the effects of cochlear pathologies on functional hearing abilities such as speech intelligibility in noise can guide the selection of features, parameter settings, and gain rationales that improve hearing aid benefit.

Classical speech audiometry generally contains a measure of word intelligibility in quiet and in some countries an additional measure of intelligibility in noise. These tests are referred to as discrimination scores. The discrimination score may indicate retro-cochlear lesions if the discrimination score decreases when increasing the presentation level of the speech. This is one traditional use of the test for diagnostic purposes. In typical clinical practice, the discrimination score is measured and is used in the fitting situation. It is interpreted qualitatively and guides the counseling of the clinician. A patient not approaching 100% intelligibility at moderately high presentation level might not be expected to reach full benefit of hearing-aid amplification. The counseling can therefor balance the expectations of the patient. The present invention treats the discrimination score measure as quantitative data, and can guide the selection of features, parameter settings, and gain rationales.

Specifically, the present invention uses the idea of classifying a patient into a pre-defined subject group, depending on whether or not the hearing loss is due to distortion.

By having a hearing aid user classified in terms of his functional hearing capacity; the fitting software may adjust the gain rationale and hearing aid features and parameters accordingly. The present invention is directed at realizing the potential of a classification system that facilitates the use of the data that can be obtained with conventional audiometric tests such as pure-tone audiometry and speech audiometry specifically speech discrimination testing in noise. The benefit for the user is expected to relate to improved communication in noise, since the fitting rationale and the hearing aid features and parameters may be tailored to fit the hearing aid user's quantified functional hearing. This is beyond what fitting rules can do today. Most benefit is expected for the class of hearing aid users that suffer considerably from distorted auditory processing and therefore do not receive the expected benefit from hearing aids. They will typically return to the clinic several times, and may cancel their purchase.

Audibility loss may be associated with conductive loss and inner and outer hair cell dysfunction as a consequence of noise trauma or presbycusis. Distorted auditory processing, on the other hand, may be associated with outer hair cell dysfunction and consequently loss of cochlear compression, decreased cochlear frequency selectivity, and decreased temporal coding acuity.

Reference is first made to FIG. 1, which illustrates highly schematically the devices required for carrying out a hearing aid fitting according to a first embodiment of the invention. FIG. 1 illustrates a hearing aid fitting system 100 that comprises a computing device 102 operated by a so called hearing aid fitter, wherein the computing device 102 is adapted to program a hearing aid system 101 worn by a hearing aid user 104.

Figure 2:
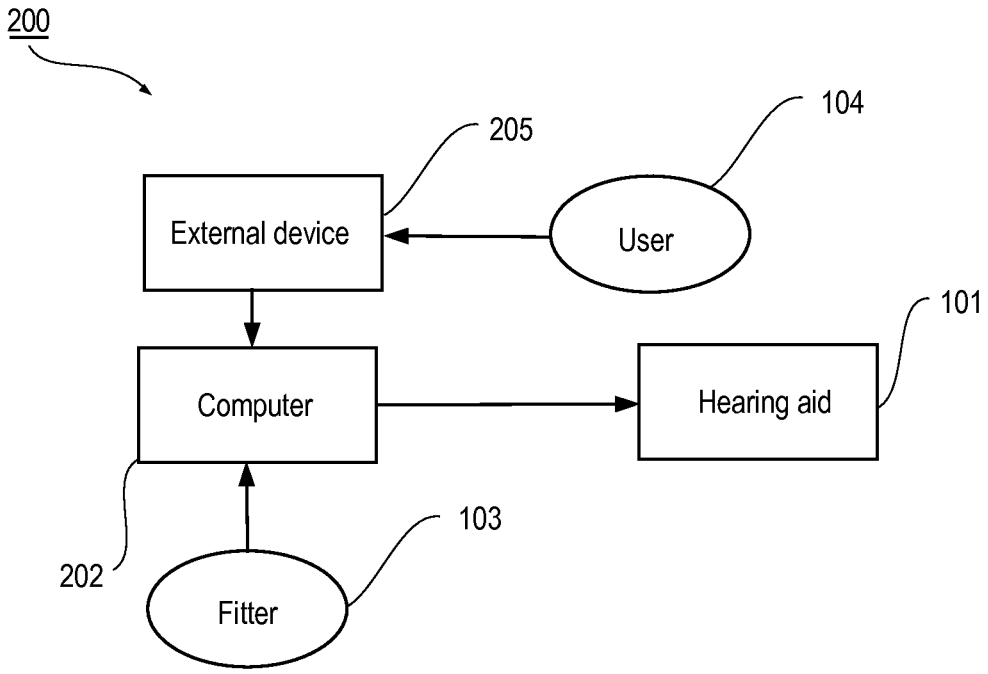
FIG. 2 illustrates highly schematically the devices required for carrying out a hearing aid fitting according to a second embodiment of the invention.

Reference is now made to FIG. 2, which illustrates highly schematically a hearing aid fitting system 200 according to a second embodiment of the invention. FIG. 2 illustrates a hearing aid fitting system 200 that comprises a computing device 202 and an external device 205, wherein the computing device 102 is operated by a hearing aid fitter 103 and is adapted to program a hearing aid system 101 worn by a hearing aid user 104 and wherein the external device 205 is adapted to receive a user input in response to speech test sounds provided to the hearing aid user by the computing device 202 through the hearing aid system 101. The external device 205 is further adapted to provide the user response to the computing device 102, whereby the hearing aid user's response to the speech test sounds can be taken into account when programming the hearing aid system 101.

The external device 205 may have a graphical user interface that allows the hearing aid user 104 to make a selection that best corresponds to the perceived speech test sound. Alternatively, the external device 205 is equipped with an automatic speech recognition (ASR) system whereby the hearing aid user 104 only needs to articulate the perceived speech test sounds in order to provide the external device with the hearing aid user response.

The use of ASR systems is especially advantageous in so far that they may allow a hearing aid fitter that is not fluent in some language or dialect to instead rely on an ASR system that may be trained to recognize basically any language and dialect. Hereby the number of hearing impaired persons that a hearing aid fitter can fit is significantly increased.

In a variation of the embodiments of FIG. 1 and FIG. 2 the hearing aid fitter 103 and hearing aid user 104 may be the same person, whereby a so-called user fitting can be carried out. The use of an ASR system is especially advantageous for user fitings since it allows the evaluation of the user response to be obtained automatically.

In the following, the various steps of a method embodiment according to the invention are described.

In a first step, that basically can be carried out at any point in time prior to the hearing aid fitting of an individual hearing aid user, a relation between intelligibility and a Speech Intelligibility Index (SII) is derived for normal hearing persons.

According to the present embodiment the term "intelligibility" is to be understood as the percentage of correct answers when presented for a multitude of independent words in noise and prompted to repeat the words. However, the intelligibility score is, according to the present embodiment, not based on the number of correctly identified words but instead based on the number of correctly identified phonemes in the words.

According to the present embodiment the term "Speech Intelligibility Index (SII)" represents a measure of speech intelligibility in noise that can be calculated based on the definitions given in the ANSI S3.5-1997 standard. The ANSI S3.5-1997 standard provides methods for predicting the intelligible amount of transmitted speech information, and thus, the speech intelligibility in a linear transmission system. The SII is always a number between 0 (speech is not intelligible at all) and 1 (speech is fully intelligible). The SII is, in fact, an objective measure of a system's ability to convey speech intelligibility and hereby hopefully making it possible for the listener to understand what is being said.

However, various other models for the prediction of the intelligibility of speech with or without the presence of a noise may also fall within the scope of an SII according to the present invention. These models require an input speech signal and an input noise signal, or a mixture of the two input signals, or particular information about the signal and noise as input, wherein the particular information may comprise, e.g., long or short-term power spectra or modulation characteristics. The models preferably account for the reduced sensitivity to the signal and noise due an individual's hearing loss. Examples of models that contain some of these properties are

- the Articulation Index (AI) (a predecessor of the SII),
- the Extended SII (ESII), (see the article "A Speech Intelligibility Index-based approach to predict the speech reception threshold for sentences in fluctuating noise for normal-hearing listeners" by Rhebergen and Versfeld in J. Acoust. Soc. Am., 117(4), pages 2181-2192, April 2005),
- the Speech Transmission Index (STI),
- the Short-Time Objective Intelligibility (STOI) (see the article "An Algorithm for Intelligibility Prediction of Time-Frequency Weighted Noisy Speech" by Taal et al, in IEEE Transactions on Audio Speech and Language Processing, pages 2125-2136, 2011), and
- the speech-based Envelope Power spectrum Model (sEPSM), (see the article "A multi-resolution envelope power based model for speech intelligibility" by Jorgensen et al. in J. Acoust. Soc. Am., 134, pages 436-446, 2013).

However, basically any model capable of providing an estimate of speech intelligibility in noise or in quiet may fall within the scope of an SII according to the present invention. However, it is preferred that the model is adapted to incorporate the effect of an individual persons hearing loss thresholds such that the estimated speech intelligibility in noise will be the same for normal hearing persons and hearing impaired persons having a so called audibility loss. In general terms the audibility loss is considered to be responsible for the elevated hearing thresholds, as determined by the audiogram, and also responsible for the substantially higher speech levels required by the hearing impaired at low noise levels. Presently, the SII, based on the ANSI standard,(and consequently also the corresponding ESII) is the only one of the mentioned models that considers loss of hearing sensitivity (audibility loss).

In order to calculate the SII an estimation of the signal and noise content of the acoustical signal is required. A number of more or less accurate methods for signal and noise estimation exist. All of these methods will be obvious to a person skilled in the art and all the methods will belong to the scope of the present embodiment.

As one example the signal and noise content may be estimated using a percentile estimator. A percentile is, by definition, the value for which the cumulative distribution is equal to or below that percentile. The output values from the percentile estimator each correspond to an estimate of a level value below which the signal level lies within a certain percentage of the time during which the signal level is estimated. A 10% percentile may be used to estimate the noise and a 90% percentile may be used to estimate the desired signal content, but other percentile figures can be used. In practice, this means that the noise level is the signal level below which the signal levels lie during 10% of the time, and the speech level is the signal level below which the signal levels lie during 90% of the time. The percentile estimator implements a very efficient way of estimating the speech and noise levels.

A percentile estimator may be implemented e.g. as the kind presented in the U.S. Pat. No. 5,687,241.

In variations of the present example other values for the percentiles may be used to determine the noise and speech estimates.

In yet other variations the noise and speech estimates are based on an Root-Mean-Square (RMS) averaging of the digital signals representing the acoustical output signals.

Now, a relation between intelligibility and a speech intelligibility index can be derived for normal hearing persons simply by carrying out a test series adapted for measuring the intelligibility for a number of normal hearing persons, calculating a speech intelligibility index for a normal hearing person for each of the acoustical test signals used in the test and subsequently interpolating the results in order to obtain the desired relation between intelligibility and speech intelligibility index.

According to further variations of the embodiments according to the present invention the measurement of "intelligibility" needs not be based on the presentation of a sequence of independent words. As one example meaningful sentences may be used instead of independent words, but also so-called nonsense syllables may be used, in which case the intelligibility score will be based on the number of correctly identified nonsense syllables. Generally, nonsense syllables are advantageous in so far that they may be considered to be language independent and therefore can be used worldwide as opposed to the language specific word or sentence tests.

However, according to a variation of the present embodiment the relation between intelligibility and a speech intelligibility index for normal hearing persons may be derived without having to resort to actual measurements and instead be based purely on published models such as those given in the article "Regression equations for the transfer functions of ANSI S3.5-1969" by Sherbecoe and Studebaker in J. Acoust. Soc. Am., 88(5), November 1990.

Figure 4:
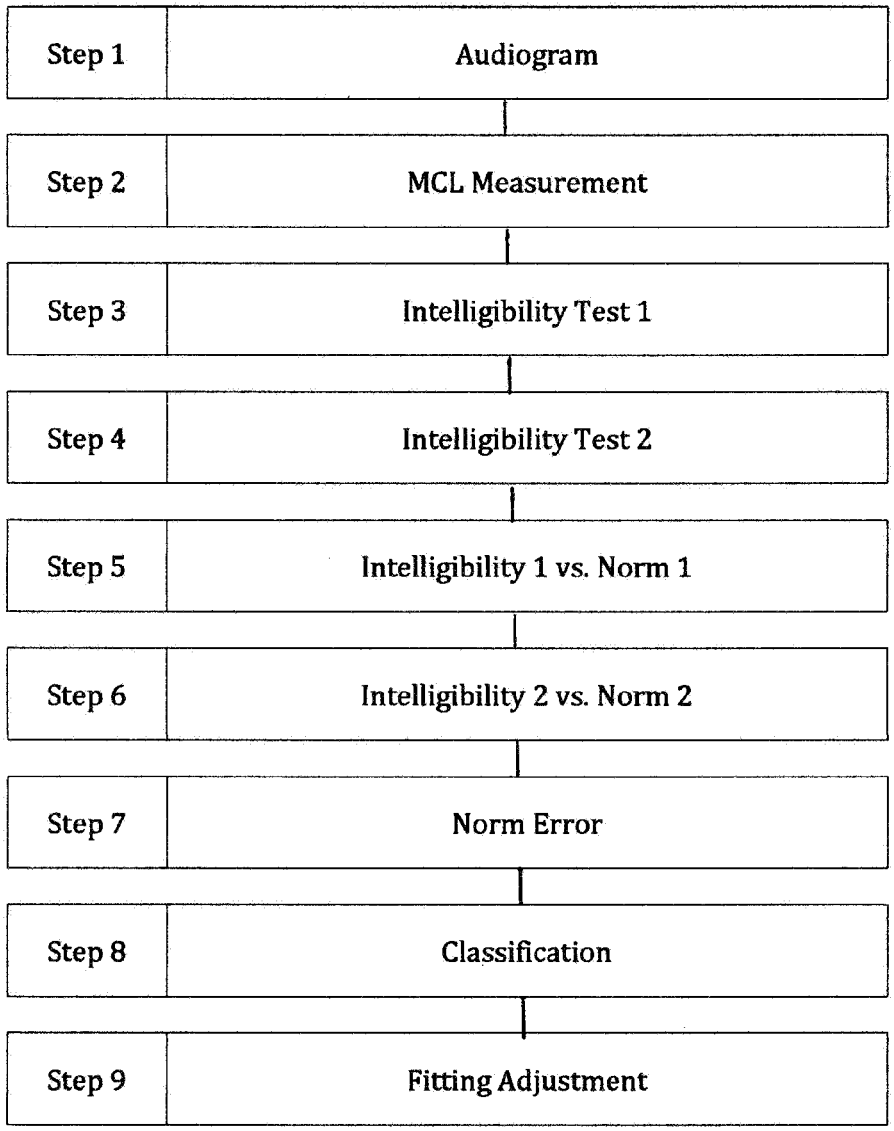
FIG. 4 is a flow diagram showing a preferred embodiment of a sequence of steps in the method according to the present invention.

Reference is now given to FIG. 4 and the steps required to be carried out for each individual hearing aid user that is about to have his hearing aid system fitted.

Initially an audiogram is obtained. The audiogram is obtained using standard pure-tone audiometry, but alternative methods for obtaining an audiogram may be used, all of which are obvious for a person skilled in the art. The method used for obtaining the audiogram is not critical for the present invention. According to the present invention the audiogram is obtained for the better ear of the individual user, i.e. the ear having the smallest hearing loss. However, in variations of the present invention the audiogram of the worse ear may be used, e.g. for persons having normal or close to normal hearing in one ear. In other variations a so called binaural audiogram may be used, wherein acoustical test signals are presented for both ears of the individual user and used to obtain the audiogram. However, in still other variations a separate audiogram is obtained for both ears of the individual. Thus in the following the term audiogram may generally represent any type of audiogram including the above mentioned variations.

The audiogram is used for calculating the corresponding value of the Speech Intelligibility Index (SII) when a specific acoustic test signal is presented for the individual hearing aid user. According to the present embodiment the value of the SII is calculated based on the ANSI S3.5-1997 standard. Calculation of the SII requires knowledge of the audiogram obtained for the individual user and of the characteristics of the acoustical signal presented to the individual user.

In a subsequent second step the Most-Comfortable-Level (MCL) is measured in quiet using a list with 50 words. The measured MCL is used to set the speech presentation level in the specific acoustic test signal for the individual hearing aid user by setting the speech presentation level equal to the measured MCL or to 80 dB(A), in case the measured MCL is lower than 80 dB(A). A-weighted decibels, abbreviated dB(A), is an expression of the relative loudness of sounds in air as perceived by the human ear. In the A-weighted system, the decibel values of sounds at low frequencies are reduced, compared with unweighted decibels, in which no correction is made for audio frequency. This correction is made because the human ear is less sensitive at low audio frequencies, especially below 1000 Hz, than at high audio frequencies. In variations the the MCL and hereby the speech presentation level may be determined using basically any other scale than dB(A) such as e.g. dB Sound Pressure Level (dB SPL).

In the next step the intelligibility for the individual hearing aid user is measured using phoneme scoring based on a list with 50 words presented as acoustical speech test signals in noise wherein the speech presentation level is set as described above in the second step and wherein the noise level is set such that a first predicted intelligibility of 70% is expected based on the derived relation between intelligibility and SII for normal hearing persons, hereby providing a first measured intelligibility.

According to the present embodiment the 50 words presented as acoustical speech test signals are based on recorded speech and based on the recognized standard for speech audiometry known as the Hearing In Noise Test (HINT). The noise is stationary and spectrally matched to the average long term spectrum of the speech material and the acoustical speech test signals are presented for the individual hearing aid user through a set of headphones.

In variations the 50 words presented as acoustical speech test signals may be based on synthesized words. In other variations the acoustical speech test signals are presented for the user through a single hearing aid, a set of hearing aids or from a set of loudspeakers.

In variations of the present embodiment the presented words may be based on another standard than (HINT) such as the Speech Perception In Noise (SPIN). However, the presented words need not be based on such a standard and in further variations the number of words to be presented may be selected to include more or fewer words than the 50 words used in the present embodiment.

In further variations of the present embodiment the noise is non-stationary and based on recorded noise such as multi-talker babble or factory noise. In yet further variations non-stationary or modulated noise is provided. This may, according to one variation, be provided by feeding white noise to a Finite Impulse Response (FIR) filter adapted to shape the frequency spectrum of white noise such that it matches an average long term spectrum of a given speech material and subsequently frequency modulating the output from the FIR filter with such a low frequency that the resulting frequency spectrum still matches the average long term spectrum of the given speech material.

According to the present embodiment the intelligibility is measured in the same way when establishing the relation between intelligibility and the SII for normal hearing person and when measuring the intelligibility for an individual hearing aid user. However, in variations the measurements need not be carried out in exactly the same manner. As one example the number of presented words may differ as may the noise spectrum and the manner in which the acoustical speech test signals are presented.

When the intelligibility is measured (as a percentage of correctly identified phonemes), then the corresponding SII is calculated based on the audiogram of the better ear of the individual hearing aid user and based on the speech and noise levels of the acoustical test signals, hereby providing a first SII value.

In a fourth step the intelligibility for the individual hearing aid user is measured as given above in the third step except for the fact that the noise level is set such that a second predicted intelligibility of 30% is expected, hereby providing a second measured intelligibility and a second SII value.

In a fifth step the difference between the first measured intelligibility and a first norm intelligibility is calculated, wherein the first norm intelligibility is determined, for the first SII value, and using the previously derived relation between intelligibility and SII, for normal hearing persons, hereby providing a first difference value.

In the sixth step the difference between the second measured intelligibility and a second norm intelligibility is calculated, wherein the second norm intelligibility is determined, for the second SII value, and using the previously derived relation between intelligibility and SII, for normal hearing persons, hereby providing a second difference value.

In a seventh step a norm error is determined as the average absolute magnitude of the first and second difference values.

In an eight step the hearing loss of the individual hearing aid user is classified as belonging to a first class in case the norm error is less than a predetermined threshold of 10% and classified as belonging to a second class in case the norm error is larger than 10%. According to variations the predetermined threshold may be given a value in the range between 5% and 15% or even in the range between 5% and 25%.

In another variation of the present embodiment a norm error is defined by the slope difference between the curves relating the norm intelligibility and the measured intelligibility as a function of the speech intelligibility index. In this case the predetermined threshold is set to be 10% intelligibility per 0.1 points of change in the speech intelligibility index and in variations the predetermined threshold may be given a value in the range between 5% and 15% intelligibility per 0.1 points of change in the speech intelligibility index or even in the range between 5% and 25%.

In further variations the predetermined threshold is selected based on the language used when measuring the intelligibility and in still further variations the predetermined threshold may depend on other parameters of the intelligibility measurements such as the noise characteristics of the presented acoustical speech test signals and in yet further variations the predetermined threshold may be determined in dependence on whether the presented acoustical speech test signals comprised independent words, meaningful sentences or nonsense syllables.

In the following a hearing loss that is classified as belonging to the first class may also be denoted an audibility loss, and a hearing loss that is classified as belonging to the second class may also be denoted a distortion loss. Additionally the terms hearing deficit and hearing loss may be used interchangeably.

In a ninth step a hearing aid gain, a hearing aid feature or a hearing aid parameter is set based on the result of said classification.

In variations, the classification may include more than two hearing loss classes. As one example the classification may comprise three classes, wherein audibility losses are in the first class, moderate distortion losses are in the second class and severe distortion losses are in the third class. According to this example the norm errors less than 10% are in the first class, norm errors larger than 10% and less than 30% are in the second class and norm errors larger than 30% are in the third class. However, in further variations the second predetermined threshold may be selected from a range between 15% and 40%.

In still other variations of the present embodiment, the setting of a hearing aid gain, a hearing aid feature or a hearing aid parameter is not based solely on the result of a classification but may also be based directly on the quantitative value (i.e. the magnitude) of the norm error. Especially the quantitative value of the norm error may be used to quantify a distortion loss that can be used to determine the magnitude of the hearing aid adjustments carried out in response to the classification. Obviously the quantitative value of the norm error may as well be used to quantify an audibility loss.

This however may be less advantageous since the audibility loss may also be quantified based on the audiogram. According to one embodiment of the present invention a noise reduction algorithm is adapted in response to the result of the hearing loss classification such that the noise reduction algorithm is less attenuating in a frequency range for audibility losses relative to distortion losses because hearing aid users having the latter type of hearing loss will typically benefit more from an aggressive noise reduction.

More specifically the adaption of the noise reduction algorithm may comprise the steps of:

setting the gain in at least one frequency channel in order to optimize a speech intelligibility index, adjusting, after the initially setting of the gain, the gain in at least one frequency channel with a value in the range between +3 dB and −6 dB for hearing deficits classified in the first hearing loss class, or adjusting, after the initially setting of the gain, the gain in at least one frequency channel with a value in the range between 0 dB and −12 dB for hearing deficits classified in the second hearing loss class.

Generally the goal, according to this embodiment, is not to increase the signal-to-noise ratio, but to attenuate as much as possible without compromising speech understanding, i.e. assuring that audible speech cues are still audible. For hearing deficits belonging to the first class it is critical for intelligibility that the sound (mixture of speech and noise) is audible at a comfortable level. Hearing aid users within this category will therefore prefer a noise reduction algorithm that does not attenuate as much as the default setting suggests.

According to another embodiment of the present invention a hearing aid compressor is adapted, for persons having an audibility loss, to have relative less compression compared to the set-up for persons having a distortion loss. Preferably the compression ratio may be in the range of 1:1-1.5:1 for persons having an audibility loss. Persons with audibility loss generally are capable of processing and interpreting a signal with modulation characteristics similar to the original signal. Persons with audibility loss are also likely to benefit and prefer dynamic range compression systems with slow time constants which produce a more stable and natural sound image. Persons with distortion loss, on the other hand, are generally not able to exploit the signal information conveyed in the dips of amplitude modulations. Instead they prefer and benefit from a processed signal with reduced modulation depth, typically rendered by compression systems with compression ratios larger than 1.5:1 and relatively fast time constants.

According to yet another embodiment of the present invention a hearing aid having the beam forming feature is especially recommended for hearing aid users with distortion losses because these hearing aid users generally experience spatially separated noise as relatively more detrimental and therefore also will benefit relatively more from the beam forming feature.

According to still another embodiment of the present invention a hearing aid compressor is adapted, for persons having an audibility loss, to be prescribed with a gain that is equal to or higher than a conventional audiogram-based gain prescription (e.g. NAL-NL2, DSL or manufacturer proprietary rationales). The hearing aid users having audibility losses are generally better at tolerating high sound pressure levels and do not severely suffer from problems with abnormal loudness growth (i.e. loudness recruitment) which conventional gain rationales are considering. Persons having distortion loss are to be prescribed with a gain that is equal to or lower than a conventional audiogram-based gain prescription. Hearing aid users having distortion losses are generally suffering from abnormal loudness growth since this is associated with the type of auditory pathology that is characteristic of distortion losses. Conventional gain rationales do consider abnormal loudness growth, but typically not to the extent necessary for persons with a significant distortion loss.

Figure 3:
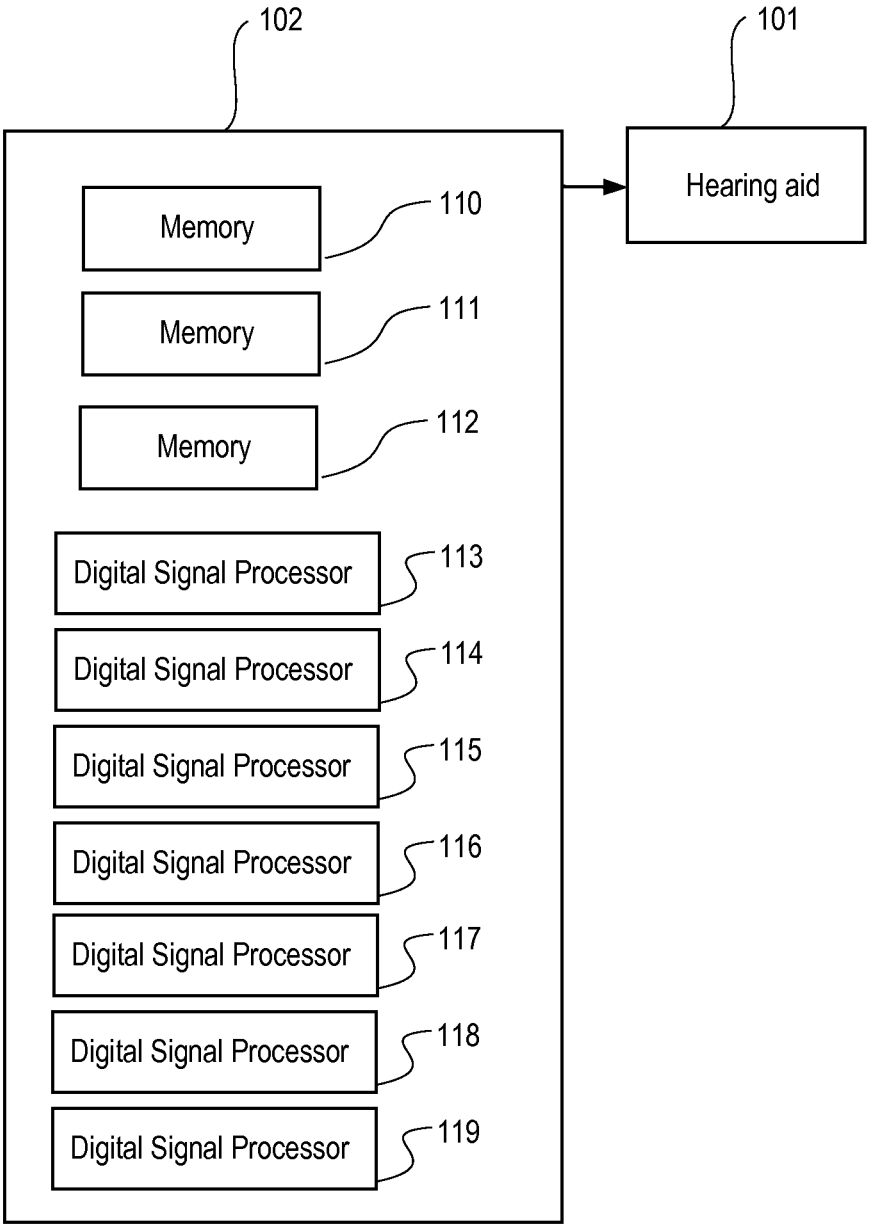
FIG. 3 illustrates highly schematically additional details of selected parts of a hearing aid fitting system according to an embodiment of the invention.

According to a variation of the disclosed embodiments the steps of classifying the measured intelligibility as belonging to a certain hearing loss class is omitted and instead the norm error (i,e, the value of the norm error) is used directly to set a gain or hearing aid parameter. According to a specific variation of the method according to the invention the gain or hearing aid parameter is set based directly on a look-up table that stores corresponding values of the norm error and the gain or hearing aid parameter to be adjusted in the hearing aid system. As will be obvious for a person skilled in the art the functionality of the look-up table may be implemented in a number of alternative ways such as a mathematical function or algorithm that provides the value of the gain or hearing aid parameter to be adjusted directly as a function of the norm error. Reference is now made to FIG. 3 that illustrates highly schematically a hearing aid fitting system with some additional details compared to FIG. 1. The computer 102 of the hearing aid fitting system 100 comprises a number of memories (110, 111 and 112) and a number of digital signal processors (113, 114, 115, 116, 117, 118 and 119).

The first memory 110 holds data representing a first digital signal and a second digital signal representing a first and a second speech test signal with a first and a second signal-to-noise-ratio respectively, the second memory 111 holds data representing an audiogram of the person wearing the hearing aid system and the third memory 112 holds data representing a relation between the relative correctness of the response as a function of the value of the speech intelligibility index, wherein the relation is obtained based on the performance of persons having normal hearing.

The first digital signal processor 113 is adapted to process the first and the second digital signal in order to provide the speech test signals to a person wearing the hearing aid system through an electrical-acoustical output transducer of the hearing aid system. The second digital signal processor 114 is adapted to prompt the person wearing the hearing aid system to respond by providing the content of the speech test signals and adapted to receive the response, from the person wearing the hearing aid system, to the speech test signals. The third digital signal processor 115 is adapted to calculate a first and a second value representing the relative correctness of the response for the speech test signals. The fourth digital signal processor 116 is adapted to determine a first and a second value of a speech intelligibility index for the first and the second speech test signal respectively, wherein the audiogram of the person wearing the hearing aid system is taken into account. The fifth digital signal processor 117 is adapted to calculate a norm error based on the difference between a value representing the relative correctness of the response from a hearing impaired person wearing the hearing aid system and a value of the relative correctness obtained from the third memory, wherein the same value of the speech intelligibility index is used to obtain both values of the relative correctness. The sixth digital signal processor 118 is adapted to determine whether the norm error is above or below a predetermined threshold and to classify the hearing loss of the hearing impaired person wearing the hearing aid system in dependence on said determination, and the seventh digital signal processor 119 is adapted to set a hearing aid gain, feature or parameter in dependence on said classification.

According to variations at least some of the various memories and digital signal processors may be integrated into one memory or one digital signal processors respectively.

According to a further variation the sixth digital signal processor 118 is not adapted to classify the hearing loss, and the seventh digital signal processor 119 is not adapted to set a hearing aid gain, feature or parameter in response to said classification. Instead the sixth digital signal processor 118 is adapted to calculate a hearing aid gain or parameter adjustment in response to the magnitude of the norm error, and the seventh digital signal processor 119 is adapted to set said calculated adjustment of the hearing aid gain or hearing aid parameter. It is a specific advantage of the present invention that standard available clinical measures are used to quantify a patient's functional hearing, wherein the quantification is provided in a simple manner as the magnitude of the norm error according to the invention.

It is a specific advantage of the present invention that a patient's functional hearing can be quantified without having to use time-consuming adaptive methods, such as the methods for measuring the speech-reception-threshold (SRT) that have been described in the prior art.

It is yet another specific advantage of the present invention that the quantification may be based on a set intelligibility measurements that are carried out using at least two sets of acoustical speech test signals with signal-to-noise-ratios that are spaced relatively far apart, whereby the robustness and/or precision of the intelligibility measurement and hereby the quantification of the functional hearing may be improved.

It is still another specific advantage of the present invention that by determining the quantification of the functional hearing (through the magnitude of the norm error) as the average of the absolute differences between the measured intelligibilities and the corresponding norm intelligibilities then the quality of the quantification is improved since a simple averaging of the differences would not take into account that the magnitudes of the differences may be of opposite signs.

It is yet another advantage of the present invention that a patient's functional hearing can be quantified and subsequently used for classifying a type of functional hearing loss, whereby activation of certain hearing aid features can be made dependent on said classification. Especially the classification of a functional hearing loss type may be advantageous by improving the guidance that a hearing aid fitter can provide to a hearing aid user with respect to what hearing aid features, such as e.g. beam forming, that will provide most benefit.

In still another advantage of the present invention that a patient's functional hearing can be quantified and subsequently used directly in determining the value of a hearing aid gain or a hearing aid parameter. Especially it is advantageous that a hearing aid system may initially be fit based primarily on an audiogram for the hearing aid user, and subsequently the quantification of the functional hearing is used to adjust selected settings of said initial fit.

Basically, it is a significant advantage of the present invention that an improved hearing aid fitting can be provided since the selection of hearing aid features and the setting of hearing aid gain and other hearing aid parameters can be dependent on a quantification and/or classification of the functional hearing.

The invention claimed is:

1. A method of fitting a hearing aid system for a hearing aid user comprising the steps of:

obtaining an audiogram for the hearing aid user;

presenting, for the hearing aid user, a first acoustical speech test signal, at a first signal-to-noise ratio, and prompting the hearing aid user to identify the contents of the first acoustical speech test signal, hereby providing a first measured intelligibility;

calculating a first magnitude of a speech intelligibility index for the first acoustical speech test signal, taking into account the audiogram for the hearing aid user;

determining an intelligibility for a normal hearing person, at said first magnitude of the speech intelligibility index, hereby providing a first norm intelligibility;

determining a norm error based on the difference between the first measured intelligibility and the first norm intelligibility;

classifying the measured intelligibility as belonging to a first hearing loss class in case the norm error is below a predetermined threshold;

classifying the measured intelligibility as belonging to a second hearing loss class in case the norm error is above the predetermined threshold; and setting a gain, hearing aid feature or hearing aid parameter based on the result of said classification.

2. The method according to claim 1, comprising the further steps of presenting for the hearing aid user, a second acoustical speech test signal, at a second signal-to-noise ratio, and prompting the hearing aid user to identify the contents of the second acoustical speech test signal, hereby providing a second measured intelligibility;

calculating a second magnitude of the speech intelligibility index for the second acoustical speech test signal taking into account the audiogram for the hearing aid user;

determining an intelligibility, for a normal hearing person, at said second magnitude of the speech intelligibility index, hereby providing a second norm intelligibility;

determining the norm error based on the difference between the first measured intelligibility and the first norm intelligibility and based on the difference between the second measured intelligibility and the second norm intelligibility.

3. The method according to claim 2, wherein the norm error is determined as an average of the absolute magnitudes of the difference between the first measured intelligibility and the first norm intelligibility and the difference between the second measured intelligibility and the second norm intelligibility.

4. The method according to claim 2, wherein the norm error is determined based on a difference in slope between the curve of the measured intelligibility as a function of the speech intelligibility index and the curve of the norm intelligibility as a function of the speech intelligibility index.

5. The method according to claim 4, wherein the predetermined threshold is 10% intelligibility per 0.1 points of change in the speech intelligibility index.

6. The method according to claim 2, wherein:

said first signal-to-noise ratio is selected such that the norm intelligibility is within the range of 15-45%; and said second signal-to-noise ratio is selected such that the norm, intelligibility is within the range of 55-85%.

7. The method according to claim 1, wherein the predetermined threshold is within the range of 5-20% and wherein the intelligibility is given as a percentage of correct responses from the hearing aid user.

8. The method according to claim 1, wherein the step of measuring intelligibility comprises the steps of:

presenting a sequence of words for the hearing aid user;

prompting the hearing aid user to repeat the words;

determining the percentage of correctly perceived words based on the hearing aid users response; and using the percentage of correctly perceived words as the measured intelligibility.

9. The method according to claim 8, wherein the step of presenting a sequence of words may be based on sentences or independent words.

10. The method according to according to claim 8, wherein the step of measuring an intelligibility comprises the further steps of:

determining a speech presentation level for the sequence of words to be presented for the hearing aid user based on a measurement of a Most-Comfortable-Level in quiet.

11. The method according to claim 8, wherein the step of measuring an intelligibility comprises the further step of determining the noise level of an acoustical speech test signal such that a given signal-to-noise ratio is obtained.

12. The method according to claim 8, wherein the step of measuring an intelligibility comprises the further step of shaping the noise spectrum such that the spectrum corresponds to the long term average speech spectrum of the sequence of words to be presented for the hearing aid user.

13. The method according to claim 1, wherein:

the first hearing loss class is associated with functional hearing deficits that predominantly makes at least a part of the speech spectrum inaudible, and wherein the second hearing loss class is associated with functional hearing deficits that are due to distorted auditory processing.

14. The method according to claim 1, wherein the step of measuring an intelligibility comprises the step of using automatic speech recognition for recording a user response.

15. The method according to claim 1, wherein the step of obtaining the audiogram comprises the further step of using the better-ear audiogram in case of an asymmetrical hearing loss.

16. The method according to claim 1, wherein the step of calculating a first magnitude of a speech intelligibility index for an acoustical speech test signal, taking into account the audiogram for the hearing aid user, comprises the step of adapting the speech intelligibility index such that the calculated first magnitude of the speech intelligibility index, for a given acoustical speech test signal, is the same for a normal hearing person and a hearing impaired person with an audibility loss.

17. The method according to claim 1, wherein the step of determining an intelligibility for a normal hearing person, for a given magnitude of the speech intelligibility index comprises the step of extracting the intelligibility from a relation between the intelligibility and the speech intelligibility index for normal hearing persons.

18. The method according to claim 17, wherein said relation is obtained by using interpolation for a set of corresponding values of the intelligibility and the speech intelligibility index for normal hearing persons.

19. The method according to claim 1, comprising the further steps of:

adapting a noise reduction algorithm to be less attenuating in a frequency range for hearing deficits classified in the first hearing loss class relative to hearing deficits classified in the second hearing loss class.

20. The method according to claim 19, wherein the step of adapting the noise reduction algorithm comprises the further steps of:

setting the gain in at least one frequency channel in order to optimize a speech intelligibility index;

for hearing deficits classified in the first hearing loss class adjusting, after the initially setting of the gain, the gain in at least one frequency channel with a value in the range between +3 dB and −6 dB; and for hearing deficits classified in the second hearing loss class adjusting, after the initially setting of the gain, the gain in at least one frequency channel with a value in the range between 0 dB and −12 dB.

21. The method according claim 1, comprising the further step of adapting a hearing aid compressor to provide longer attack and release times for hearing deficits classified in the first hearing loss class relative to attack and release times for hearing deficits classified in the second hearing loss class.

22. The method according to claim 1, comprising the further step of adapting a hearing aid compressor to provide a smaller compression ratio for hearing deficits classified in the first hearing loss class relative to the compression ratio for hearing deficits classified in the second hearing loss class.

23. The method according to claim 1, comprising the further steps of:

for hearing deficits classified in the first hearing loss class adapting the gain setting of a hearing aid compressor to provide a gain that is higher than a conventional audiogram-based gain prescription, and for hearing deficits classified in the second hearing loss class adapting the gain setting of a hearing aid compressor to provide a gain that is lower than a conventional audiogram-based gain prescription.

24. The method according to claim 1 comprising the further step of setting the magnitude of said gain, or said hearing aid parameter, based on the magnitude of the norm error.

25. A method of fitting a hearing aid system for a hearing aid user comprising the steps of:

obtaining an audiogram for the hearing aid user;

presenting, for the hearing aid user, a first acoustical speech test signal, at a first signal-to-noise ratio, and prompting the hearing aid user to identify the contents of the first acoustical speech test signal, hereby providing a first measured intelligibility;

calculating a first magnitude of a speech intelligibility index for the first acoustical speech test signal, taking into account the audiogram for the hearing aid user;

determining an intelligibility for a normal hearing person, at said first magnitude of the speech intelligibility index, hereby providing a first norm intelligibility;

determining a norm error based on the difference between the first measured intelligibility and the first norm intelligibility; and setting a hearing aid gain or hearing aid parameter based on the norm error.

26. A hearing aid fitting system comprising a client and link means adapted to allow the client to communicate with a hearing aid system, wherein the client further comprises:

a first digital signal, representing a first speech test signal with a first signal-to-noise-ratio, stored in a first memory;

a second digital signal, representing a second speech test signal with a second signal-to-noise-ratio, stored in the first memory;

a first digital signal processor adapted to process the first and the second digital signal in order to provide the speech test signals to a person wearing the hearing aid system through an electrical-acoustical output transducer of the hearing aid system;

a second digital signal processor adapted to prompt the person wearing the hearing aid system to respond by providing the content of the speech test signals and adapted to receive the response from the person wearing the hearing aid system to the speech test signals;

a third digital signal processor adapted to calculate a first and a second value representing the relative correctness of the response for the speech test signals;

a second memory holding data representing an audiogram of the person wearing the hearing aid system;

a fourth digital signal processor adapted to determine a first and a second value of a speech intelligibility index for the first and the second speech test signal respectively and wherein the audiogram of the person wearing the hearing aid system is taken into account;

a third memory holding data representing a relation between the relative correctness of the response as a function of the value of the speech intelligibility index, wherein the relation is obtained based on the performance of persons having normal hearing;

a fifth digital signal processor adapted to calculate a norm error based on the difference between a value representing the relative correctness of the response from a hearing impaired person wearing the hearing aid system and a value of the relative correctness obtained from the fourth memory, wherein the same value of the speech intelligibility index is used to obtain both values of the relative correctness;

a sixth digital signal processor adapted to determine whether the norm error is above or below a predetermined threshold and to classify the hearing loss of the hearing impaired person wearing the hearing aid system in dependence on said determination; and a seventh digital signal processor adapted to set a hearing aid gain, feature or parameter in dependence on said classification.

27. A hearing aid fitting system according to claim 26, wherein the seventh digital signal processor is adapted to set the magnitude of said adjustments of a hearing aid gain or parameter in dependence on the magnitude of said norm error.

* * * * *